US005194418A

United States Patent [19]

Miyauchi et al.

[11] Patent Number: 5,194,418

[45] Date of Patent: Mar. 16, 1993

[54] THERMOSENSITIVE RECORDING MATERIAL

[75] Inventors: Shinobu Miyauchi, Numazu; Norio Kurisu, Susono, both of Japan

[73] Assignee: Ricoh Company, Ltd., Tokyo, Japan

[21] Appl. No.: 749,185

[22] Filed: Aug. 23, 1991

[30] Foreign Application Priority Data

Aug. 25, 1990 [JP] Japan ..... 2-223802

[51] Int. Cl.[5] ..... B41M 5/40

[52] U.S. Cl. ..... 503/226; 127/152; 503/200

[58] Field of Search ..... 503/200, 226; 427/152, 427/150, 151

[56] References Cited

U.S. PATENT DOCUMENTS 4,590,499 5/1986 Fujimura et al. ..... 503/200
4,708,947 11/1987 Maruyama et al. ..... 503/214
5,061,677 10/1991 Yoshida et al. ..... 503/200

*Primary Examiner*—Pamela R. Schwartz
*Attorney, Agent, or Firm*—Oblon, Spivak, McClelland, Maier & Neustadt

[57] ABSTRACT

A thermosensitive recording material being composed of a support; a thermosensitive coloring layer, formed on the support, which contains a leuco dye and a color developer capable of inducing color formation in the leuco dye upon application of heat thereto; an overcoat layer, formed on the thermosensitive coloring layer, which contains a first resin component crosslinked by a first crosslinking agent; and a backcoat layer, formed on the back side of the support opposite to the thermosensitive coloring layer, which contains a second resin component crosslinked by a second crosslinking agent, with at least the first resin component being different from the second resin component or the first crosslinking agent being different from the second crosslinking agent.

10 Claims, No Drawings

THERMOSENSITIVE RECORDING MATERIAL

BACKGROUND OF THE INVENTION

1. Field of the Invention

This invention relates to a thermosensitive recording material, and more particularly to a thermosensitive recording material, utilizing a coloring reaction between a leuco dye and a color developer capable of inducing color formation in the leuco dye upon application of heat thereto, which thermosensitive recording material has high preservability.

2. Discussion of Background

Conventionally, there is known a thermosensitive recording material, in which a thermosensitive coloring layer mainly comprising a thermosensitive coloring composition is provided on a support such as a sheet of paper and synthetic paper, or a plastic film. In such a recording material colored images are obtained by application of heat to the recording material using a thermal head, thermal pen, laser beam, stroboscopic lamp, and the like.

This type of thermosensitive recording material has wide-scale utilization, not only as a recording material for copying books and documents, but also as a recording material for use with printers for electronic calculators, facsimile machines, ticket vendors, and label-recorders because of the following advantages over other conventional recording materials:

(1) image recording can be speedily performed, using a comparatively simple device without complicated steps for development and image fixing;

(2) the thermosensitive recording material can be produced and used without generating noise and causing environmental pollution; and (3) the manufacturing cost of the thermosensitive recording material is low.

The thermosensitive coloring composition for use in this type of thermosensitive recording material usually comprises a coloring agent and a color developer capable of inducing color formation in the coloring agent upon application of heat thereto. Conventionally, as such coloring agents, colorless or light-colored leuco dyes having, for example, lactone, lactam, or spiropyran rings, are employed; and as such color developers, organic acids and phenolic materials are employed. The thermosensitive recording material in which the aforementioned leuco dye and color developer are used in combination is widely used, since the color tone of the produced images is clear, the whiteness degree of the background of the thermosensitive recording material is high, and the produced images have excellent weathering resistance. The above-mentioned thermosensitive recording material, however, has the shortcoming that recorded images become easily discolored or fade away when the recorded images come into contact with oil and a plasticizer contained in a plastic film.

To eliminate the above shortcoming, it is known that an overcoat layer comprising a water-soluble polymer is formed on the thermosensitive coloring layer and that a backcoat layer comprising a water-soluble polymer is formed on the back side of the support so as to give plasticizer resistance to the thermosensitive recording material. However, the thermosensitive recording material comprising the overcoat layer and the backcoat layer comprising a water-soluble polymer also has the shortcoming. While the thermosensitive recording material in the form of a roll is stored under circumstances of high temperature and high humidity, the neighboring overcoat layer and the backcoat layer become sticky, namely, the so-called blocking problem occurs.

Several solutions to the above blocking problem have been proposed. For example, Japanese Laid-open Patent Application No. 61-57386 discloses a backcoat layer comprising alkali salts of styrene - maleic acid copolymer; Japanese Laid-open Patent Application No. 62-32081, a backcoat layer comprising colloidal silica; Japanese Laid-open Patent Application No. 63-230388, a backcoat layer comprising electroconductive titanium oxide. However, these thermosensitive recording materials do not have sufficient water resistance and barrier properties because an emulsion or a latex is employed for the backcoat layer of the thermosensitive recording material.

SUMMARY OF THE INVENTION

Accordingly, an object of the present invention is to provide a thermosensitive recording material free from the blocking problem, having excellent plasticizer resistance, water resistance, and barrier properties.

The above object of the present invention can be attained by a thermosensitive recording material comprising: (a) a support, (b) a thermosensitive coloring layer, formed on the support, which comprises a leuco dye and a color developer capable of inducing color formation in the leuco dye upon application of heat thereto, (c) an overcoat layer, formed on the thermosensitive coloring layer, which comprises a first resin component crosslinked by a first crosslinking agent, and (d) a backcoat layer, formed on the back side of the support opposite to the thermosensitive coloring layer, which comprises a second resin component crosslinked by a second crosslinking agent, at least the first resin component being different from the second resin component or the first crosslinking agent being different from the second crosslinking agent.

In addition to the above, it is preferable that the water content of the thermosensitive recording material be maintained at 7% or less, more preferably 6.5% or less of the total weight thereof from the viewpoint of prevention of the blocking problem.

DESCRIPTION OF THE PREFERRED EMBODIMENTS

Specific examples of a first resin component used for the overcoat layer in the present invention are polyvinyl alcohol and carboxylic-acid-modified polyvinyl alcohol. In the overcoat layer, when the first resin component is crosslinked by a first crosslinking agent comprising polyamide - epihalohydrin copolymer, the produced thermosensitive recording material has excellent water resistance and barrier properties. In addition to the above-mentioned polyvinyl alcohol and carboxylic-acid-modified polyvinyl alcohol, epoxy-modified polyvinyl alcohol, acetoacetyl-modified polyvinyl alcohol, and sodium alginate also can be used as the first resin component, and glyoxal also can be employed as the first crosslinking agent in the overcoat layer.

The backcoat layer for use in the present invention comprises a second resin component crosslinked by a second crosslinking agent. In the present invention, the second resin component in the backcoat layer is different from the first resin component for use in the overcoat layer, or the second crosslinking agent in the backcoat layer is different from the first crosslinking agent for use in the overcoat layer.

Specific examples of the second resin component for use in the backcoat layer are polyvinyl alcohol and a modified polyvinyl alcohol, while specific examples of the second crosslinking agent are melamine-formaldehyde resin, glyoxal, a glycidyl amine type crosslinking agent, an aziridine type crosslinking agent, and a zirconium compound.

When the second resin component further comprises chitosan in the backcoat layer, the produced thermosensitive recording material has excellent water resistance. The amount ratio of chitosan to the second resin component in the backcoat layer is 1 to 50 wt. %, preferably 5 to 30 wt %.

The amount ratio of the second crosslinking agent such as glyoxal or melamin-formaldehyde resin to the second resin component is 1 to 20 wt %, preferably 2 to 10 wt %. In the case of the other second crosslinking agents than the above, the amount ratio of the second crosslinking agent to the second resin component is 5 to 60 wt %, preferably 10 to 40 wt %.

As the second crosslinking agent, any conventional zirconium compounds, aziridine type crosslinking agents, and glycidyl amine type crosslinking agents can be used in the backcoat layer of the thermosensitive recording material of the present invention.

Specific examples of the zirconium compound serving as the second crosslinking agent are as follows: $Na_2ZrSiO_5$, $ZrOCl_2.8H_2O$, $ZrOSO_4.nH_2O$, $ZrO(NO_3)_2.4H_2O$, $ZrO(CO_3)_2.nH_2O$, $ZrO(OH)_2.nH_2O$, $ZrO(C_2H_3O_2)_2$, $(NH_4)_2ZrO(CO_3)_2$, $ZrO(C_{18}H_{35}O_2)_2$, $ZrO(C_8H_{15}O_2)_2$, $ZrSiO_4$, and $ZrO_2$.

Specific examples of the aziridine type crosslinking agent serving as the second crosslinking agent are as follows:

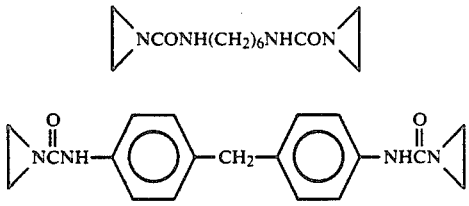

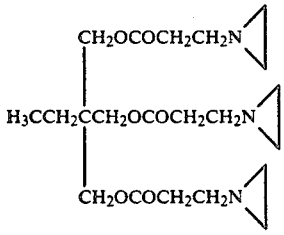

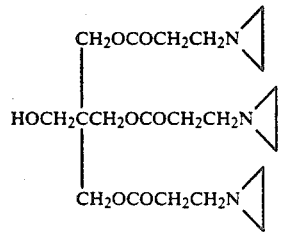

-continued

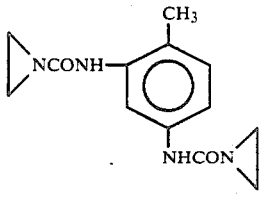

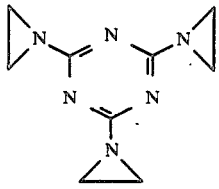

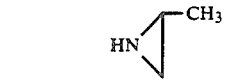

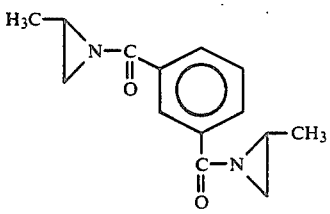

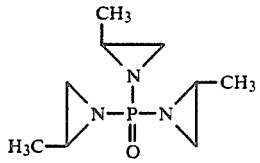

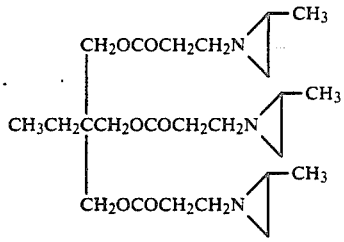

Specific examples of the modified polyvinyl alcohol serving as the first resin component in the overcoat layer and as the second resin component in the backcoat layer are as follows: anion-modified polyvinyl alcohols such as carboxyl-group-modified polyvinyl alcohol, sulfonic-acid-group-modified polyvinyl alcohol and phosphoric-acid-group-modified polyvinyl alcohol; cation-modified polyvinyl alcohols; and modified polyvinyl alcohols prepared by polymerizing the polyvinyl alcohol and ethylene or (meta)acrylamide.

The ratio of polymerization of the (modified) polyvinyl alcohol serving as the first and second resin components is not specifically limited, but preferably in the range of 100 to 3000.

The ratio of saponification of the (modified) polyvinyl alcohol serving as the first and second resin components is not specifically limited, but preferably in the range of 70 to 100 mol %.

In particular, when the second resin component for use in the backcoat layer comprises a polyvinyl alcohol and chitosan, it is preferable that the polyvinyl alcohol have a saponification ratio of 97 mol % or more.

In addition, when the overcoat layer of the thermosensitive recording material according to the present invention comprises a modified polyvinyl alcohol crosslinked by polyamide - epihalohydrin copolymer, and the backcoat layer comprises polyvinyl alcohol with a saponification ratio of 97 mol % or more crosslinked by polyamide epihalohydrin copolymer, the preferable results can be obtained in the present invention.

Further in the present invention, when necessary, auxiliary additive components such as a filler, a thermofusible material (or a lubricant), and a surface active agent, which are used in the conventional thermosensitive recording materials, can also be contained in the overcoat layer and the backcoat layer.

Examples of the filler for use in the present invention include finely-divided particles of inorganic fillers such as calcium carbonate, silica, zinc oxide, titanium oxide, aluminum hydroxide, zinc hydroxide, barium sulfate, clay, talc, surface-treated calcium and surface-treated silica; and finely-divided particles of organic fillers such as urea - formaldehyde resin, styrene - methacrylic acid copolymer and polystyrene resin.

Examples of the thermofusible material are as follows: fatty acids such as stearic acid and behenic acid; amides of fatty acids such as stearic acid amide, palmitic acid amide; metal salts of fatty acids such as zinc stearate, aluminum stearate, calcium stearate, zinc palmitate and zinc behenate; p-benzylbiphenyl, terphenyl, triphenyl methane, benzyl p-benzyloxybenzoate, β-benzyloxynaphthalene, phenyl β-naphthoate, phenyl 1-hydroxy-2-naphthoate, methyl 1-hydroxy-2-naphthoate, diphenyl carbonate, dibenzyl terephthalate, dimethyl terephthalate, 1,4-dimethoxynaphthalene, 1,4-diethoxynaphthalene, 1,4-dibenzyloxynaphthalene, 1,2-bis(phenoxy)ethane, 1,2-bis(3-methylphenoxy)ethane, 1,2-bis(4-methylphenoxy)ethane, 1,4-bis(phenoxy)butane, 1,4-bis(phenoxy)-2-butene, dibenzoylmethane, 1,4-bis(phenylthio)butane, 1,4-bis(phenylthio)-2-butene, 1,3-bis(2-vinyloxyethoxy)benzene, 1,4-bis(2-vinyloxyethoxy)benzene, p-(2-vinyloxyethoxy)biphenyl, p-aryloxybiphenyl, p-propargyloxybiphenyl, dibenzoyloxymethane, 1,3-dibenzoyloxypropane, dibenzyl disulfide, 1,1-diphenylethanol, 1,1-diphenylpropanol, p-(benzyloxy)benzyl alcohol, 1,3-diphenoxy-2-propanol, N-octadecyl carbamoyl-p-methoxycarbonyl benzene and N-octadecylcarbamoyl benzene.

In the present invention, as the leuco dye for use in the thermosensitive coloring layer, which can be used alone or in combination, any conventional leuco dyes for use in conventional thermosensitive materials can be employed. For example, triphenylmethane-type leuco compounds, fluoran-type leuco compounds, phenothiazine-type leuco compounds, auramine-type leuco compounds, spiropyran-type leuco compounds, and indolinophtalide-type leuco compounds are preferably employed. Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-N-methyl-N-isobutyl-6-methyl-7-anilinofluoran,
3-N-ethyl-N-isoamyl-6-methyl-7-anilinofluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-ethyl-N-p-tolyl)-6-methyl-7-anilinofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-diethylamino-6-methyl-7-(2',4'-dimethylanilino)fluoran,
3-(N,N-diethylamino)-5-methyl-7-(N,N-dibenzylamino)fluoran, benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)fluoran,
3-(N-methyl-N-isopropylamino)-6-methyl-7-anilinofluoran,
3-dibutylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-N-ethyl-N-(2-ethoxypropyl)amino-6-methyl-7-anilinofluoran,
3-N-ethyl-N-tetrahydrofurfurylamino-6-methyl-7-anilinofluoran,
3-diethylamino-6-methyl-7-mesidino-4',5'-benzofluoran,
3-diethylamino-6-dimethylaminofluorene-9-spiro-3'-(6'-dimethylamino)phthalide, 3,6-bis(diethylamino)fluorene-9-spiro-3,-(6'-dimethylamino)phthalide,
3-dibutylamino-6-dimethylaminofluorene-9-spiro-3'-(6'-dimethylamino)phthalide,
3-diethylamino-6-dimethylaminofluorene-9-spiro-3'-(6'-diethylamino)phthalide,
3,3-bis[2-(p-dimethylaminophenyl)-2-(p-methoxyphenyl)ethenyl]-4,5,6,7-tetrachlorophthalide, and
3-(4'-diethylamino-2'-methoxyphenyl)-3-[4''-(p-diethylaminophenyl)-4''-(p-chlorophenyl)-1''-3''-butadienyl]-benzo[α]-phthalide.

As the color developer for use in the thermosensitive coloring layer in the present invention, various electron acceptors which work upon the above-mentioned leuco dyes to induce color formation, such as phenolic compounds, thiophenolic compounds, thiourea derivatives, organic acids and metal salts thereof, are preferably employed.

Specific examples of such color developers are as follows:
4,4'-isopropylidenebisphenol,
4,4'-isopropylidenebis(o-methylphenol),
4,4'-sec-butylidenebisphenol,
4,4'-isopropylidenebis(2-tert-butylphenol),
4,4'-cyclohexylidenediphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methylphenol),
1,1,3-tris(2-methyl-4-hydroxy-5-tert-butylphenyl)butane,
1,1,3-tris(2-methyl-4-hydroxy-5-cyclohexylphenyl)butane,
4,4'-thiobis(6-tert-butyl-2-methylphenol),
4,4'-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,7-bis(4-hydroxyphenylthio)-3,5-dioxaheptane,
1,5-bis(4-hydroxyphenylthio)-3-oxapentane,
1,3-bis(4-hydroxyphenylthio)-propane,
1,3-bis(4-hydroxyphenylthio)-2-hydroxypropane,
N,N'-diphenylthiourea,
N,N'-di(m-chlorophenyl)thiourea,
salicylanilide,
5-chloro-salicylanilide,
2-hydroxy-3-naphthoate,
2-hydroxy-1-naphthoate,
1-hydroxy-2-naphthoate,
metal salts such as zinc, aluminum, calcium of hydroxynaphthoate,
bis-(4-hydroxyphenyl)methyl acetate,
bis-(4-hydroxyphenyl)benzyl acetate,
1,3-bis(4-hydroxycumyl)benzene,
1,4-bis(4-hydroxycumyl)benzene,
2,4'-diphenolsulfone,
3,4-dihydroxy-4'-methyldiphenylsulfone,
3,3'-diallyl-4,4'-diphenolsulfone,
α,α-bis(4-hydroxyphenyl)-α-methyltoluene,
antipyrine complex of zinc thiocyanate,
tetrabromobisphenol A, and
tetrabromobisphenol S.

A variety of conventional binder agents can be employed for binding the leuco dye and color developer to the support of the thermosensitive recording material of the present invention.

Specific examples of the binder agent are as follows: polyvinyl alcohol; starch and starch derivatives; cellulose derivatives such as hydroxymethylcellulose, hydroxyethylcellulose, carboxymethylcellulose, methylcellulose, and ethylcellulose; water-soluble polymers such as sodium polyacrylate, polyvinyl pyrrolidone, acrylamide - acrylic acid ester copolymer, acrylamide acrylic acid ester - methacrylic acid terpolymer, alkali salts of styrene - maleic anhydride copolymer, alkali salts of isobutylene - maleic anhydride copolymer, polyacrylamide, sodium alginate, gelatin, and casein; emulsions such as polyvinyl acetate, polyurethane, polyacrylic acid ester, polymethacrylic acid ester, vinyl chloride - vinyl acetate copolymer, and ethylene - vinyl acetate copolymer; and latexes such as styrene - butadiene copolymer and styrene - butadiene - acrylic acid derivative copolymer.

Moreover, when necessary, the auxiliary additive components which are used in the conventional thermosensitive recording materials, such as a filler, a dispersant, a stabilizer for colored images, an antioxidant, an anti-foaming agent, a light stabilizer, a fluorescent brightener, a surface active agent, and a thermofusible material (or a lubricant) can be employed with the above-mentioned leuco dye and the color developer in the thermosensitive coloring layer. Specific examples of the filler and the thermofusible material are the same as those employed in the overcoat layer and the backcoat layer.

As the support for use in the present invention, a sheet of paper is usually employed. In addition to paper, nonwoven fabric, plastic films, synthetic paper, metal foils, and composite sheets comprising the above materials, can also be employed for the support.

A method for preparing the thermosensitive recording material of the present invention is as follows: first a coating solution for the thermosensitive coloring layer comprising the above-mentioned components is coated on the support such as a sheet of paper, synthetic paper, or a plastic film, and then dried. Next, a coating solution for the overcoat layer comprising the above-mentioned components is coated on the thermosensitive coloring layer, and then dried. Finally a coating solution for the backcoat layer comprising the above-mentioned components is coated on the back side of the support and then dried.

The thermosensitive recording material of the present invention can be utilized in a variety of fields especially related to high-speed recording as a recording material required to have improved stability of obtained images. For example, the thermosensitive recording material of the present invention can be used as a thermosensitive recording type label sheet and thermosensitive recording type magnetic ticket paper. The thermosensitive recording type label sheet can be obtained by repeating the same procedure for preparation of the thermosensitive recording material of the present invention and further providing a release backing paper on the back side of the backcoat layer with an adhesive layer interposed between the backcoat layer and the release backing paper. Meanwhile, the thermosensitive recording type magnetic ticket paper can be obtained in the same way as the thermosensitive recording type label sheet, except that the release backing paper used for the thermosensitive recording type label sheet is replaced by a magnetic recording layer comprising a ferromagnetic substance and a binder as the main components.

In the present invention, it is preferable that the water content of the thermosensitive recording material be 7% or less, more preferably 6.5% or less of the total weight thereof from the viewpoint of prevention of the blocking problem.

Other features of this invention will become apparent in the course of the following description of exemplary embodiments, which are given for illustration of the invention and are not intended to be limiting thereof.

EXAMPLE 1

Preparation for a coating liquid for the thermosensitive coloring layer

The following components were separately dispersed in a ball mill for 24 hours to obtain a liquid A and a liquid B.

| | parts by weight |
|---|---|
| [Liquid A] | |
| 3-(N-methyl-N-cyclohexylamino)-6-methyl-7-anilinofluoran | 20 |
| 10% aqueous solution of hydroxyethylcellulose | 20 |
| Water | 60 |
| [Liquid B] | |
| Bisphenol A | 15 |
| Calcium carbonate | 5 |
| 10% aqueous solution of polyvinyl alcohol | 20 |
| Water | 60 |

The above liquids A and B were mixed at a mixing ratio of 1:1 to prepare a coating liquid for the thermosensitive coloring layer.

Preparation for a coating liquid for the overcoat layer

The following components were mixed and stirred to prepare a liquid C, so that a coating liquid for the overcoat layer was obtained.

| [Liquid C] | parts by weight |
|---|---|
| 20% dispersion of silicon dioxide | 10 |
| 30% dispersion of zinc stearate | 1 |
| 10% aqueous solution of itaconic-acid-modified polyvinyl alcohol | 40 |
| 12.5% aqueous solution of polyamide-epichlorohydrin | 9 |
| Water | 40 |

Preparation for a coating liquid for the backcoat layer

The following components were mixed and stirred to prepare a liquid D, so that a coating liquid for the backcoat layer was obtained.

| [Liquid D] | parts by weight |
|---|---|
| 20% dispersion of aluminum hydroxide | 15 |
| 30% dispersion of zinc stearate | 1 |
| 10% aqueous solution of polyvinyl alcohol (the ratio of saponification: 97 mol % or more) | 40 |
| 10% aqueous solution of glyoxal | 2 |
| Water | 54 |

The coating liquid for the thermosensitive coloring layer was coated, by a wire bar, on a sheet of high quality paper with a basis weight of 50 g/m$^2$, in a deposition amount of 5.5 g/m$^2$ on a dry basis, and then dried, so that the thermosensitive coloring layer was formed on the support.

The coating liquid for the overcoat layer was then coated, by a wire bar, on the above-prepared thermosensitive coloring layer, in a deposition amount of 3.5 g/m$^2$ on a dry basis, and then dried, so that the overcoat layer was formed on the thermosensitive coloring layer.

The coating liquid for the backcoat layer was coated, by a wire bar, on the back side of the above sheet of high quality paper serving as a support, on a deposition amount of 2 g/m$^2$ on a dry basis, and then dried, so that the backcoat layer was formed on the back side of the support.

Finally the produced recording material was subjected to the calendering treatment by passing the recording material through a calender roll three times at a speed of 10 m/minute with a load of 30 kg/cm$^2$ applied thereto, so that a thermosensitive recording material of the present invention was obtained.

EXAMPLE 2

The procedure for preparation of the thermosensitive recording material in Example 1 was repeated except that 2 parts by weight of a 10% aqueous solution of glyoxal contained in the liquid D for use in the backcoat layer in Example 1 was replaced by 4 parts by weight of a 5% aqueous solution of melamine-formaldehyde resin, so that a thermosensitive recording material of the present invention was obtained.

EXAMPLE 3

The procedure for preparation of the thermosensitive recording material in Example 1 was repeated except that 2 parts by weight of a 10% aqueous solution of glyoxal in the liquid D for use in the backcoat layer in Example 1 was replaced by 4 parts by weight of a 10% ammonia water of zirconium carbonate, so that a thermosensitive recording material of the present invention was obtained.

EXAMPLE 4

The procedure for preparation of the thermosensitive recording material in Example 1 was repeated except that 2 parts by weight of a 10% aqueous solution of glyoxal in the liquid D for use in the backcoat layer in Example 1 was replaced by 1 part by weight of trimethylolpropane-tri-β-aziridinylpropionate, so that a thermosensitive recording material of the present invention was obtained.

EXAMPLE 5

The procedure for preparation of the thermosensitive recording material in Example 1 was repeated except that 2 parts by weight of a 10% aqueous solution of chitosan was added to the components of the liquid D for use in the backcoat layer in Example 1, so that a thermosensitive recording material of the present invention was obtained.

EXAMPLE 6

The procedure for preparation of the thermosensitive recording material in Example 2 was repeated except that 2 parts by weight of a 10% aqueous solution of chitosan was added to the components of the coating liquid for the backcoat layer used in Example 2, so that a thermosensitive recording material of the present invention was obtained.

EXAMPLE 7

The procedure for preparation of the thermosensitive recording material in Example 3 was repeated except that 2 parts by weight of a 10% aqueous solution of chitosan was added to the components of the coating liquid for the backcoat layer used in Example 3, so that a thermosensitive recording material of the present invention was obtained.

EXAMPLE 8

The procedure for preparation of the thermosensitive recording material in Example 4 was repeated except that 2 parts by weight of a 10% aqueous solution of chitosan was added to the components of the coating liquid for the backcoat layer used in Example 4, so that a thermosensitive recording material of the present invention was obtained.

EXAMPLE 9

The procedure for preparation of the thermosensitive recording material in Example 1 was repeated except that 2 parts by weight of a 10% aqueous solution of glyoxal in the liquid D for use in the backcoat layer in Example 1 was replaced by 10 parts by weight of a 12.5% aqueous solution of polyamide - epichlorohydrin, so that a thermosensitive recording material of the present invention was obtained.

EXAMPLE 10

The procedure for preparation of the thermosensitive recording material in Example 1 was repeated except that 40 parts by weight of a 10% aqueous solution of itaconic-acid-modified polyvinyl alcohol and 9 parts by weight of a 12.5% aqueous solution of polyamide - epichlorohydrin in the liquid C for use in the overcoat layer in Example 1 were respectively replaced by 40 parts by weight of a 10% aqueous solution of polyvinyl alcohol with the saponification ratio of 97 mol % or more and 4 parts by weight of a 5% aqueous solution of melamine-formaldehyde resin, so that a thermosensitive recording material of the present invention was obtained.

COMPARATIVE EXAMPLE 1

The procedure for preparation of the thermosensitive recording material in Example 1 was repeated except that the liquid C used as the coating liquid for the overcoat layer in Example 1 was also used as the coating liquid for the backcoat layer instead of the liquid D, so that a comparative thermosensitive recording material was obtained.

COMPARATIVE EXAMPLE 2

The procedure for preparation of the comparative thermosensitive recording material in Comparative Example 1 was repeated except that 9 parts by weight of a 12.5% aqueous solution of polyamide - epichlorohydrin in the liquid C used for the overcoat layer and the backcoat layer in Comparative Example 1 was replaced by 1 part of trimethylolpropane-tri-β-aziridinylpropionate, so that a comparative thermosensitive recording material was obtained.

COMPARATIVE EXAMPLE 3

The procedure for preparation of the thermosensitive recording material in Example 1 was repeated except that 2 parts by weight of a 10% aqueous solution of glyoxal in the liquid D for use in the backcoat layer in Example 1 was not used, so that a comparative thermosensitive recording material was obtained.

COMPARATIVE EXAMPLE 4

The following components were mixed and stirred to prepare a liquid E.

| [Liquid E] | parts by weight |
|---|---|
| 25% ammonium salts of styrene-maleic anhydride copolymer | 37.5 |
| 50% dispersion of calcium carbonate | 31.3 |
| Water | 31.2 |

The procedure for preparation of the thermosensitive recording material in Example 1 was repeated except that the liquid D used for the backcoat layer in Example 1 was replaced by the above-prepared liquid E, so that a comparative thermosensitive recording material was obtained.

The thus obtained thermosensitive recording materials were subjected to a blocking test, a water resistance test, and a plasticizer resistance test. The method of each test is as follows:

(i) Blocking Test

Immediately after each of the above thermosensitive recording materials was subjected to calendering, the recording material was divided into two groups by controlling the water content of the thermosensitive recording material to be 9% and 6%. Thereafter each recording material was cut into a 25 mm ×150 mm sample, and 30 sheets of the samples were piled up. Each pile of the sample sheets was sealed to maintain the original water content thereof, and then a load of 2.5 kg was applied to the pile of sample sheets at an area of 25 mm ×10 mm on either side of the pile. After each pile of sample sheets was allowed to stand at 40° C. for 24 hours, the blocking problem of each thermosensitive recording material was evaluated by calculating how many sample sheets were able to be peeled off.

(ii) Water Resistance Test

Each of the above-prepared samples of the thermosensitive recording materials was allowed to stand at 40° C. in a dry atmosphere for 15 hours. After it was dipped into water of 20° C. for 24 hours, the water resistance of the thermosensitive recording material was evaluated by rubbing the coated surface of the backcoat layer with the finger.

(iii) Plasticizer Resistance Test

After each sample of the thremosensitive recording material was allowed to stand at 40° C. in a dry atmosphere for 15 hours, images were thermally printed thereon by using a thermal block of 150° C. under the following conditions:

| | |
|---|---|
| Applied pressure | 2 kg/cm$^2$ |
| Contact time | 1 second |

Three polyvinyl chloride films were laminated on the back side of each sample of the thermosensitive recording material, and each sample was allowed to stand at 50° C. in a dry atmosphere for 48 hours, with a load of 150 g/cm$^2$ applied thereto. Thereafter, the density of printed images was measured with Macbeth densitometer RD-914.

The results of the above tests are shown in Table 1.

TABLE 1

| Example No. | Blocking Test(*) Water Content 9% | 6% | Water Resistance (**) | Plasticizer Resistance (Image Density) |
|---|---|---|---|---|
| Example 1 | 24 | 27 | 4 | 1.35 |
| Example 2 | 25 | 28 | 4 | 1.34 |
| Example 3 | 25 | 28 | 4 | 1.34 |
| Example 4 | 25 | 27 | 4 | 1.35 |
| Example 5 | 24 | 26 | 5 | 1.34 |
| Example 6 | 24 | 27 | 5 | 1.35 |
| Example 7 | 24 | 27 | 5 | 1.34 |
| Example 8 | 25 | 28 | 5 | 1.35 |
| Example 9 | 25 | 28 | 3 | 1.34 |
| Example 10 | 22 | 25 | 4 | 1.35 |
| Comparative Example 1 | 0 | 6 | 5 | 1.34 |
| Comparative Example 2 | 3 | 8 | 4 | 1.34 |
| Comparative Example 3 | 24 | 26 | 1 | 1.34 |
| Comparative Example 4 | 25 | 28 | 1 | 0.40 |

(*)25 to 30 sheets: No blocking problem. Excellent quality.
20 to 24 sheets: No blocking problem. Good quality.
15 to 19 sheets: Slight blocking problem.
5 to 14 sheets: Blocking problem.
0 to 4 sheets: Serious blocking problem.
(**)5: Very good
4: Good
3: Normal
2: Poor
1: Very poor It is obvious from Table 1 that the thermosensitive recording materials of the present invention cause no blocking problem and have good water resistance and plasticizer resistance, so that the preservability is proved to be excellent.

What is claimed is:

1. A thermosensitive recording material comprising:
(a) a support,
(b) a thermosensitive coloring layer, formed on said support, which comprises a leuco dye and a color developer capable of inducing color formation in said leuco dye upon application of heat thereto,
(c) an overcoat layer, formed on said thermosensitive coloring layer, which comprises a first resin component crosslinked by a first crosslinking agent, and
(d) a backcoat layer, formed on the back side of said support opposite to said thermosensitive coloring layer, which comprises a second resin component crosslinked by a second crosslinking agent,
at least said first resin component being different from said second resin component or said first crosslinking agent being different from said second crosslinking agent.

2. The thermosensitive recording material as claimed in claim 1, wherein said first resin component is different from said second resin component.

3. The thermosensitive recording material as claimed in claim 1, wherein said first crosslinking agent is different from said second crosslinking agent.

4. The thermosensitive recording material as claimed in claim 1, wherein said first resin component is selected from the group consisting of polyvinyl alcohol and a modified polyvinyl alcohol, and said first crosslinking agent comprises polyamide - epihalohydrin copolymer in said overcoat layer.

5. The thermosensitive recording material as claimed in claim 1, wherein said first resin component is selected from the group consisting of polyvinyl alcohol and a modified polyvinyl alcohol, and said first crosslinking agent comprises polyamide - epihalohydrin copolymer in said overcoat layer, and said second resin component for use in said backcoat layer comprises one component selected from the group consisting of polyvinyl alcohol and a modified polyvinyl alcohol, and said second crosslinking agent for use in said backcoat layer is selected from the group consisting of melamine-formaldehyde resin, glyoxal, a glycidyl amine crosslinking agent, an aziridine crosslinking agent, and a zirconium compound.

6. The thermosensitive recording material as claimed in claim 5, wherein said second resin component for use in said backcoat layer further comprises chitosan.

7. The thermosensitive recording material as claimed in claim 5, wherein said second resin component comprises said polyvinyl alcohol, and further comprises chitosan.

8. The thermosensitive recording material as claimed in claim 7, wherein said polyvinyl alcohol has a saponification ratio of 97 mol % or more.

9. The thermosensitive recording material as claimed in claim 1 wherein water content thereof being 7 % or less.

10. A thermosensitive recording material comprising:
(a) a support,
(b) a thermosensitive coloring layer, formed on said support, which comprises a leuco dye and a color developer capable of inducing color formation in said leuco dye upon application of heat thereto,
(c) an overcoat layer, formed on said thermosensitive coloring layer, which comprises a modified polyvinyl alcohol crosslinked by polyamide - epihalohydrin copolymer, and
(d) a backcoat layer, formed on the back side of said support opposite to said thermosensitive coloring layer, which comprises polyvinyl alcohol with a saponification ratio of 97 mol % or more crosslinked by polyamide - epihalohydrin copolymer.

* * * * *

UNITED STATES PATENT AND TRADEMARK OFFICE

CERTIFICATE OF CORRECTION

PATENT NO. : 5,194,418

DATED : MARCH 16, 1993

INVENTOR(S) : SHINOBU MIYAUCHI ET AL

It is certified that error appears in the above-identified patent and that said Letters Patent is hereby corrected as shown below:

Column 12, line 66, "thremosensitive" should read --thermosensitive--.

Signed and Sealed this

Twenty-fourth Day of May, 1994

*Attest:*

Bruce Lehman

BRUCE LEHMAN

*Attesting Officer*

*Commissioner of Patents and Trademarks*